US006290537B1

(12) United States Patent
Sommer

(10) Patent No.: US 6,290,537 B1
(45) **Date of Patent: *Sep. 18, 2001**

(54) ELECTRICAL PLUG-IN CONNECTION

(75) Inventor: Stefan Sommer, Saulgau (DE)

(73) Assignee: ZF Friedrichshafen AG, Friedrichshafen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/371,622

(22) Filed: Aug. 11, 1999

(30) Foreign Application Priority Data

Oct. 22, 1998 (DE) ..... 198 48 725

(51) Int. Cl.[7] ..... H01R 13/73

(52) U.S. Cl. ..... 439/559; 439/273; 439/271; 277/370

(58) Field of Search ..... 439/273, 271, 439/272, 276, 936, 559, 556, 548; 174/153 R, 153 G; 74/18.1, 89.15; 277/589, 940, 370

(56) References Cited

U.S. PATENT DOCUMENTS

| | | | | |
|---|---|---|---|---|
| 4,840,585 | | 6/1989 | Muzslay | 439/556 |
| 5,145,402 | | 9/1992 | Plyler et al. | 439/459 |
| 5,324,207 | * | 6/1994 | Itoh et al. | 439/271 |
| 5,334,039 | * | 8/1994 | Kanda | 439/271 |
| 5,518,419 | * | 5/1996 | Denyer et al. | 439/559 |
| 5,567,170 | * | 10/1996 | Kroeber | 439/272 |
| 5,618,204 | * | 4/1997 | Nix et al. | 439/271 |
| 5,634,808 | * | 6/1997 | Shinji | 439/271 |
| 5,879,178 | * | 3/1999 | Koumatsu et al. | 439/271 |

OTHER PUBLICATIONS

Japanese Abstract, No. 08031501A dated Feb. 2, 1996 to Matsumoto Masaji Aitatsuku:KK.

Japanese Abstract, No. 10064618 A dated Mar. 6, 1998 to Yazaki Corp.

* cited by examiner

*Primary Examiner*—Renee Luebke
*Assistant Examiner*—Briggitte R. Hammond
(74) *Attorney, Agent, or Firm*—Davis & Bujold, P.L.L.C.

(57) ABSTRACT

The electrical plug-in connection for connecting one electronic module within an automatic transmission for motor vehicles with a feed line provided outside the housing have a plug which penetrates a bore with play in the housing. A matching plug in the shape of a bushing wherein plug and matching plug are provided with grooves or ribs to form a bayonet interlocking. In the space between the plug and the bore is provided a molded seal which, when the matching plug is slipped on, becomes deformed and hermetically seals the bore.

5 Claims, 1 Drawing Sheet

ELECTRICAL PLUG-IN CONNECTION

BACKGROUND OF THE INVENTION

This invention relates to an arrangement for electrical plug-in connection of an electronic module fitted in an automatic transmission for motor vehicles, especially a selector unit with one feed line situated outside the transmission.

In automatic transmissions, such as have been variously produced by the applicant, the transmission electronics is usually situated inside the transmission housing and connected, via a plug-in connection which penetrates the transmission housing, with the feed line that is outside the automatic transmission. In this regard, it has proved advantageous that the plug-in connection usually consisting of a plug and a matching plug being disposed in the housing perpendicularly, i.e. in the assemblage direction of the selector unit placed in the transmission with the electronic module.

The problem arises here that there have to be compensated manufacturing tolerances which result in a play between the bore in the transmission housing and the plug penetrating said bore. One possibility of compensating the manufacturing tolerances consists in that the plug-in connection be floatingly supported in the transmission housing, but such a floating support has the added disadvantage of considerable space needed vertically; difficulties also appear in contacting the pressed screen customarily used in the electronic module as electrical conductor with the junctions in the case of a floating support of said plug-in connection.

The problem to be solved by this invention is to provide an electrical plug-in connection which overcomes said disadvantages and makes possible for a rigid connection with the transmission housing while, at the same time, contacting the stamped screen without problem placed in the electronic module inside the transmission.

SUMMARY OF THE INVENTION

The plug-in connection according to the invention, which is shaped as a rigid connection with the transmission housing, makes possible an easy and economic contacting of the stamped screen in the transmission housing and, at the same time, reduce total height by virtue of said direct contacting. The plug inserted with play in the bore of the transmission housing and connected with the stamped screen in the electronic module has, on its outside, several grooves or ribs which extend forming an angle with the longitudinal axis. While the matching plug in the form of a bushing, which is superimposed on the plug creates the connection with the current supply disposed outside the housing. The matching plug has on its inner wall ribs or grooves adapted to the grooves and ribs of the plug. A bayonet interlocking is implementing when the matching plug is superimposed on the plug.

The tolerance between plug and bore is compensated by the inserted molded seal, wherein it is possible, almost without effort by virtue of the bayonet interlocking, to superimpose the matching plug with deformation of the molded seal.

BRIEF DESCRIPTION OF THE DRAWINGS

Hereinbelow the invention is explained with the aid of the drawing in which advantageous embodiments are shown. In the drawing.

DESCRIPTION OF THE PREFERRED EMBODIMENTS

In the figures, where the same reference numbers have been given to the same parts, 1 means one part of a housing for an automatic transmission for motor vehicles in which are situated a selector unit (not shown) and an electronic module 6, the latter to be connected with a feed line provided outside the housing 1 of the automatic transmission.

Figure 1:
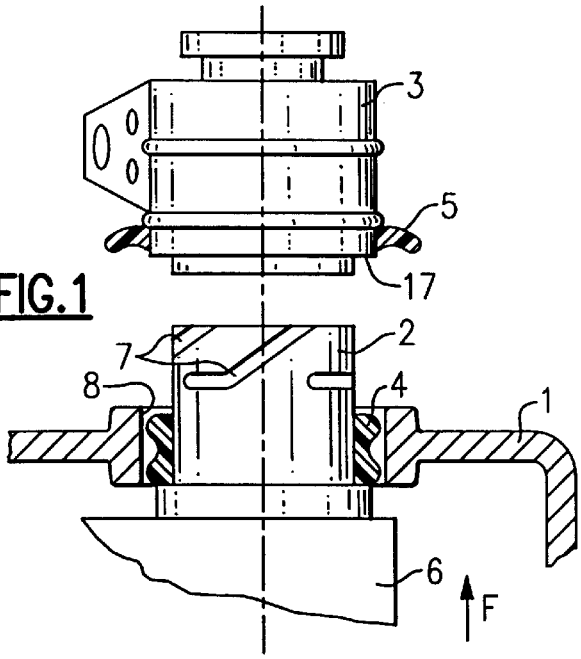
FIG. 1 is a perspective view of an arrangement according to the invention prior to assemblage.

There is an arrangement in the transmission housing. The arrangement is perpendicular to the electrical plug-in connection in the assemblage direction of the selector unity (as indicated by the arrow F in FIG. 1). The arrangement has a bore 8 provided in the housing 1. The bore 8 and a plug 2 engage with considerable play. The plug 2 is provided with a multiplicity of contact pins which contact corresponding contact points in the stamped screen (not shown) in the electronic module 6.

The plug 2 has disposed along its outer periphery several grooves or ribs 7 forming an angle, which together with corresponding ribs grooves 10 in a recess of the matching plug 3, makes possible a bayonet interlocking of said two parts. The matching plug 3, shown in FIG. 1 in a position prior to assemblage, has substantially the shape of a bushing, and when assembled is superimposed on the plug 2 and sunk therein with a light rotational movement.

Figure 2:
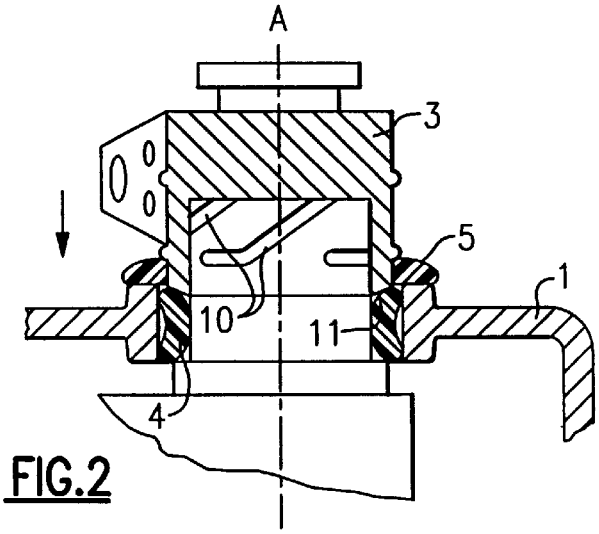
FIG. 2 is a section through the arrangement according to the invention after assemblage.

FIG. 2 shows a section through the arrangement, according to the invention, in assembled state. It is observed that a molded seal 4 inserted in the bore 8 and surrounding the plug 2 is deformed by the lower edge 11 of the bushing-shaped matching plug 3 in a manner, such that the space between the outer wall of the plug 2 and the inner wall of the bore 8, is hermetically locked.

The matching plug 3 is also provided with a mud edge (seal) 5 which, after assemblage of matching plug 3 and plug 2, as can be seen in FIG. 2, abuts against the on the upper side of the housing 1 and offers additional protection.

Figure 3:
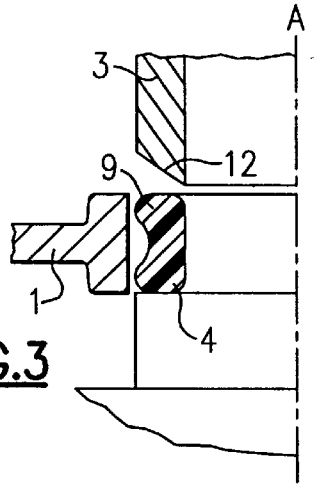
FIG. 3 to FIG. 5 show different developments of the molded seal and of the matching plug in transverse section.

From the transverse section in FIG. 3 can be seen that in a preferred embodiment the molded seal 4, seen in cross section, has an outwardly oriented bulge 9 so that when sinking the edge of the matching plug 3, which in this embodiment has a chamfer 12 that extends forming an angle with its longitudinal axis A, the bulge is deformed in direction of the housing 1.

Figure 4:
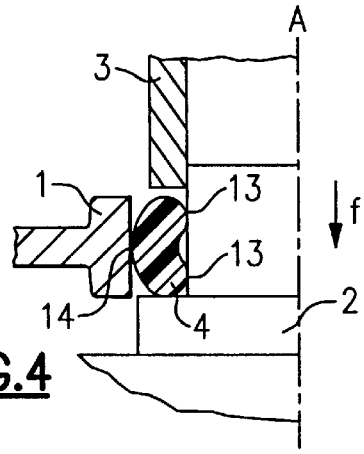

In FIG. 4 can be seen a cross section where the molded seal 4 is shaped forming an arc and is inserted in the bore 8, in the space surrounding the plug 2, in a manner such that both ends 13 of the arc abut on the plug 2 while the vertex 14 abuts on the bore 8. Due to the penetration of the lower edge of the matching plug 3 in direction of the arrow f, the seal 4 is deformed with hermetic locking of the space between plug 2 and bore 8.

Figure 5:
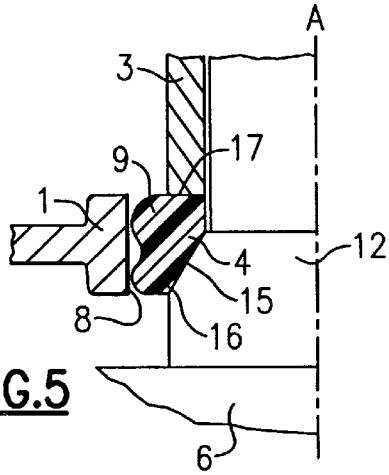

In the embodiment shown in FIG. 5, the upper section of the plug 2 has a chamfer 15 disposed forming an angle with its longitudinal axis A, wherein the molded seal 4 inserted between the plug 2 and the bore 8 has a chamfer 16 adapted thereto and in addition again a bulge 9 that faces the bore and is deformed by the lower edge 17 of the matching plug 3 during the assemblage.

In all these embodiments is ensured a rigid tie of the plug 2 to the electronic module 6 with the stamped screen situated therein; the parts are simple and of reasonable price and can be assembled almost without effort; by the direct contact in the electronic module 6 a reduced total height is ensured; the required tolerance compensation is achieved by the molded seal provided in all its preferred embodiments.

| Reference numerals | |
|---|---|
| 1 | housing |
| 2 | plug |
| 3 | matching plug |
| 4 | molded seal |
| 5 | mudedge |
| 6 | electronic module |
| 7 | rib or groove |
| 8 | bore |
| 9 | bulge |
| 10 | rib or groove |
| 11 | lower edge |
| 12 | chamfer |
| 13 | arc end |
| 14 | vertex |
| 15 | plug chamfer |
| 16 | molded seal chamfer |
| 17 | plug lower edge |
| A | longitudinal axis |

What is claimed is:

1. An electrical plug-in connection of an electronic module of a selector unit of an automatic transmission of a motor vehicle, the electrical plug-in connection facilitating supply of electricity to the electronic module and comprising:

a first plug (2) having a leading portion extending through a bore (8) of the transmission, the bore (8) of the transmission having a diameter larger than a diameter of the leading portion of the first plug (2) so that a gap is formed between and inwardly facing wall of the bore (8) and an outer wall of the leading portion of the first plug (2), and one of a plurality of grooves and ribs being provided on an outer wall of the leading portion of the first plug (2);

a molded seal (4) located within the gap between the outer wall of the first plug (2) and the inwardly facing wall of the bore (8) of the transmission and spaced from the leading portion;

a mating second plug (3) having a first leading end with a recess formed therein, an inner wall of the recess having one of a plurality of corresponding ribs and grooves provided thereon for interlocking engagement with the one of the plurality of grooves and ribs provided on the outer wall of the first plug (2) to facilitate releasable engagement between the first plug (2) and the mating second plug (3), the mating second plug (3) further having an annular mud seal (5) surrounding an exterior portion of the first leading end of the mating second plug (3) and a second remote end of the mating second plug (3) for electrical connection with a source for supplying electricity to the electronic module; and the first leading end of the mating second plug (3), following engagement with the first plug (2), abuts and deforms the molded seal (4) into contact with both the inwardly facing wall of the bore (8) and the outer wall of the first plug (2) to form a seal therewith, and the annular mud seal (5) abuts against an exterior surface of a housing (1) of the transmission to form a seal therewith.

2. The electrical plug-in connection according to claim 1, wherein the molded seal (4) has at least one outwardly oriented bulge which facilitates formation of a hermetic seal with the bore (8) and the first plug (2) when the mating second plug (3) engages with the first plug (2).

3. The electrical plug-in connection according to claim 1, wherein the molded seal (4) has an arc shape with opposed arcuate end portions (13) and a central vertex (14), and the two arcuate end portions (13) abut with the outer wall of the first plug (2) and the vertex abuts with the inner wall of the bore (8) following engagement between the first plug (2) and the mating second plug (3).

4. The electrical plug-in connection according to claim 1, wherein the molded seal (4) has a chamfered surface (16), the chamfered surface (16) of the molded seal (4) abuts with a mating chamfer (15) formed on the first plug (2), and the chamfered surface of the molded seal (4) and the chamfered surface of the plug facilitate formation of a hermetic seal with the bore (8) and the first plug (2) when the mating second plug (3) engages with the first plug (2).

5. The electrical plug-in connection according to claim 1, wherein the first leading end (12) of the mating second plug (3) is provided with a chamfer for engagement with the molded seal (4) which facilitates formation of a hermetic seal with the bore (8) and the first plug (2) when the mating second plug (3) engages with the first plug (2).

* * * * *